United States Patent [19]

John

[11] 4,408,516

[45] Oct. 11, 1983

[54] GRAPHITE FIBRE VIOLIN

[76] Inventor: Leonard K. John, 6154 Slarfield Crescent, Mississauga, Ontario, Canada, L5N 1X1

[21] Appl. No.: 295,942

[22] Filed: Aug. 24, 1981

[51] Int. Cl.[3] ..... G10D 1/02

[52] U.S. Cl. ..... 84/275; 84/291; 84/452 P

[58] Field of Search ..... 84/193, 275, 291, 452 P

[56] References Cited

U.S. PATENT DOCUMENTS

| | | | |
|---|---|---|---|
| 3,699,836 | 10/1972 | Glasser | 84/291 |
| 3,724,312 | 4/1973 | Yamada et al. | 84/193 |
| 3,880,040 | 4/1975 | Kaman | 84/291 |
| 4,161,130 | 7/1979 | Lieber | 84/267 |

*Primary Examiner*—Lawrence R. Franklin

[57] ABSTRACT

A violin is constructed with an acoustic box formed of composite materials, sheets of unidirectional graphite fibre in a resin matrix. The soundboard is constructed of paired sheets of the composite material overlaid and bonded with the sheets symmetrically placed. The fibres of a first pair of sheets are aligned with the longitudinal axis of the soundboard to transmit vibrations through the full length of the soundboard. The fibres of a second pair of sheets are oriented perpendicular to the longitudinal axis to provide structural strength in a perpendicular direction. The fibres of a third pair of sheets are oriented at an acute angle to the longitudinal axis, fibres of one sheet oriented at about 45 degrees to the axis, and those of the other sheet at about minus 45 degrees. The third pair provides torsional rigidity, and provides additional stiffness in the longitudinal direction, thereby affecting the tonal qualities of the violin. The symmetric lay-up avoids internal stresses which would otherwise affect performance.

15 Claims, 6 Drawing Figures

GRAPHITE FIBRE VIOLIN

FIELD OF THE INVENTION

The invention relates to the construction of a violin whose acoustic box is formed of composite materials.

DISCUSSION OF THE PRIOR ART

Materials and techniques for construction violins have changed very little since developments recognized during the 16th to 18th centuries. The soundboard of a violin is typically constructed of pine and the back of curly maple, and occasionally woods such as pear and sycamore are used. Because the properties of wood vary significantly, there is little consistency in the tonal qualities of violins even when made from the same piece of wood by the same maker.

Furthermore, the performance of a particular violin with an acoustic box of conventional wood construction can vary significantly with its environment. The moisture content of the wood changes markedly with humidity, and consequently the vibrational qualities of a violin tend to be unpredictable. Additionally, repeated drying and rehydrating can fatigue the wood, and excessive drying can produce wood splitting. For such reasons, priceless violins and quality performance instruments are stored in temperature and humidity controlled environments when not in use.

The varnish applied to conventional violin acoustic boxes is another factor contributing to variations in tonal qualities. Varnish has a significant sound dampening effect, and the type of varnish together with the thickness of application will significantly affect the sound produced by a violin. Further variations in vibration characteristics of a conventional violin occur when the varnish ages, and its dampening properties change.

In summary, although classic construction techniques and materials produce fine instruments, it is difficult to build instruments of predictable and maintainable tonal quality. It is a primary object of the invention to provide a violin construction which permits reproduceable performance characteristics and which is less sensitive to environmental factors.

SUMMARY OF THE INVENTION

The soundboard is the primary sound generating element of a violin acoustic box. According to the invention the soundboard of a violin is constructed in sheets in unidirectional graphite fibres embedded in a resin matrix, bonded in overlaid relationship. The fibres of a first pair of sheets are aligned with the longitudinal axis of the soundboard to transmit vibrations through the full length of the soundboard. The fibres of a second pair of sheets are oriented transverse to the longitudinal axis at an acute angle to provide torsional rigidity, and to provide additional stiffness in the longitudinal direction thereby affecting the vibrational qualities of the soundboard. To prevent the build up of internal stresses which would affect the performance of the acoustic box, the fibres of a first sheet of the second pair are oriented at a predetermined angle relative to the longitudinal axis, and the fibres of the second sheet of the second pair are oriented at substantially minus the predetermined angle. Additionally, to further reduce internal stresses, the lay-up of the sheets is substantially symmetric about a hypothetical three-dimensional curve of the general shape of the soundboard. The sheets of each pair are therefore symmetrically placed about the hypothetical three-dimensional curve, and any additional sheets provided are similarly oriented.

GENERAL DISCUSSION OF THE INVENTION

A violin constructed according to the invention has an acoustic box formed of composite materials whose material properties can be preselected and consistently reproduced. This represents a marked departure from past experience with violins of principally wood construction. The construction is otherwise traditional, the violin being modeled on conventional violins, and having a similar neck, scroll, bridge etc. The general design object was in fact to produce a violin of traditional construction, in particular shape, weight and appearance, which would be readily accepted by violinists.

The tonal qualities of a violin formed of composite materials are very difficult to predict. The instrument cannot be readily modelled, and as a design guide a simple analogy was drawn between a soundboard and a point-loaded beam, the point of loading being the bridge. This analogy served as a useful starting point, but ultimately empirical testing was required to determine whether a satisfactory result would be obtained. Several factors which could be expected to affect the qualities of the final product include, principally, fibre type, fibre orientation, ply orientation, selection of a resin matrix, and the curing procedure followed to set the composite materials.

Three types of fibres were considered: Aramid, glass and graphite. Aramid was eliminated because it was felt to have excessive sound dampening properties. Glass fibre was eliminated because of its relatively low modulus of elasticity, which meant that in the context of the particular ply arrangement selected, the vibrational qualities of a wood soundboard could not be closely approximated. Graphite fibres were ultimately considered the most suitable material.

Commercially available composite graphite sheets of three different fibre orientations were considered: unidirectional sheets, woven sheets, and "chopped matt." All other factors being equal, unidirectional fibre sheets have the greatest stiffness (modulus of elasticity), albeit only along an axis parallel to the fibres, little structural strength being available in a direction perpendicular to the fibres. Woven sheets with fibres directed in mutually perpendicular directions display structural strength in mutually perpendicular directions. However, the kinking inherent in the weaving process generally produces a weakness in the fibres. Chopped matt with its relatively random orientation was considered unsatisfactory: its modulus of elasticity was considered too low for the fibre orientation and number of plies selected. Woven sheets might prove useful, especially if the sheets are tailored to have greater rigidity in a particular direction thereby effectively acting as unidirectional sheets, but an additional complication with woven sheets is the necessity to apply additional coatings of resin to the finished members of the acoustic box in order to produce a smooth surface aesthetically satisfactory to a violinist. Furthermore, additional resin might significantly affect the weight of a violin, and any inconsistency in the process of applying the resin would lead to variations in the tonal qualities of the violins produced: unidirectional fibre sheets were therefore selected for the construction of the soundboard.

The lay-up or relative orientation of the fibre plies of the soundboard was determined with a view to providing a soundboard having the vibrational characteristics of a conventional wood soundboard, given the type of fibre sheets selected. Paired plies are oriented parallel to the longitudinal axis of the soundboard to provide structural rigidity in the longitudinal direction and to transmit vibrations generated at the bridge throughout the full length of the soundboard. Additional paired plies are oriented at an acute angle in the range of 30–60 degrees (preferably about 45 degrees) to provide a measure of torsional rigidity, and to add further flexural stiffness in the axial direction.

A substantially symmetric lay-up was selected. The sheets of each pair are evenly spaced about a hypothetical three-dimensional curve having the general shape of the soundboard, and each ply whose fibres are oriented at a predetermined angle relative to the longitudinal axis is matched by a corresponding ply whose fibres are angled at substantially minus that acute angle. The symmetric lay-up avoids internal stresses which would otherwise affect the tonal qualities of the finished instrument.

The curing method used to set the plies of the soundboard (and of other members) will affect the mechanical properties of the composite sheets, including their vibrational characteristics. Cure pressure may typically vary from vacuum (typically 14 PSI) to 100 PSI, and a denser packing of fibres will occur with increased pressure. Curing under high pressure will increase the interlaminar shear strength of the composite, but use of excessive pressure with a particular lay-up and selection of materials can produce a finished violin with a very tinny sound, as higher pressure will produce a stiffer composite.

During curing, resin can be bled from the composite sheet, thereby increasing fibre content, and creating a more rigid structure. A desired ultimate composition can be achieved by incorporating an excess quantity of resin and then bleeding away a predetermined amount. It was considered preferable, however, to bleed only unwanted gases produced by volatile constituents of the composite materials in order to prevent voids which would affect performance of the material.

Other factors affecting the construction of a violin embodying the invention will be discussed in greater detail in the description of two preferred embodiments.

DESCRIPTION OF PREFERRED EMBODIMENTS

Figure 1:
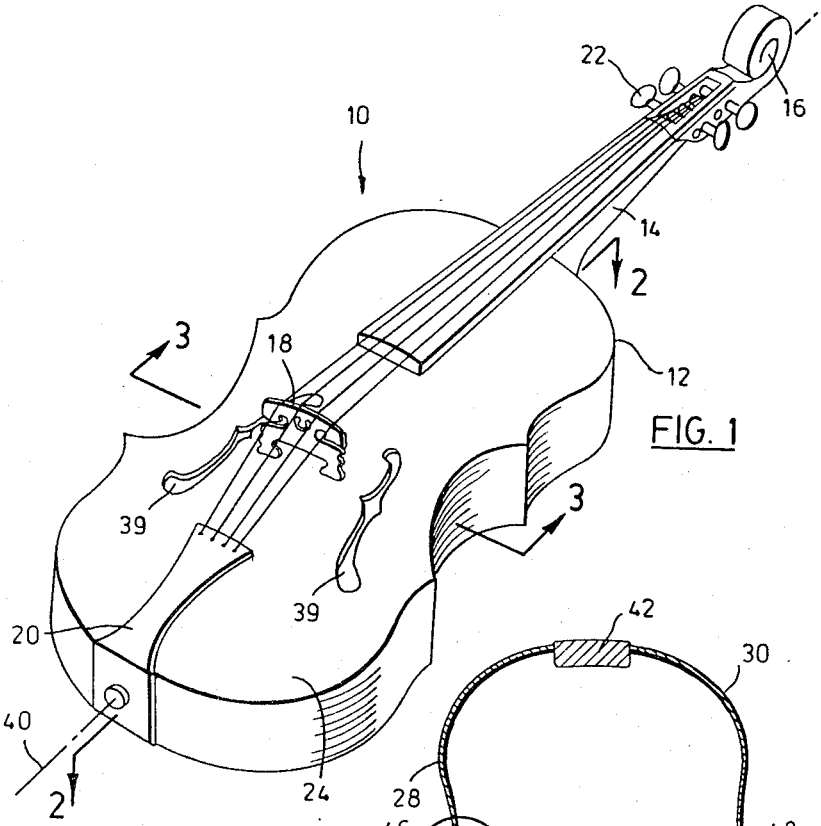
FIG. 1 is a perspective view of a violin constructed according to the invention.

Reference is made to FIG. 1 which illustrates a violin 10 embodying the invention. The violin 10 has an acoustic box 12 constructed of composite materials, but is otherwise of generally conventional shape, dimension and construction. The violin has conventional component members, including a neck 14, a scroll 16, a bridge 18, tail piece 20, pegs 22 etc.

Figure 5:
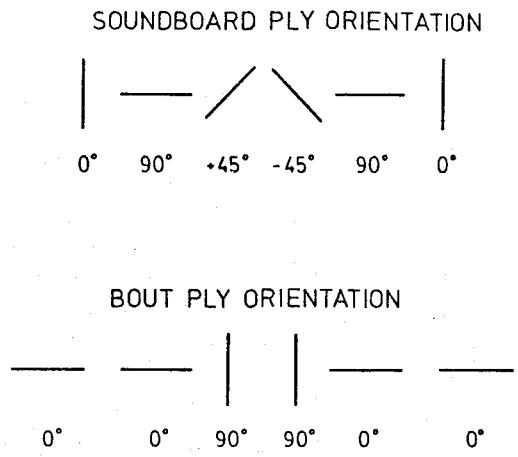
FIG. 5 diagrammatically illustrates a first set of ply orientations for the soundboard, back and sides of the violin; and, FIG. 6 diagrammatically illustrates a second set of ply orientations.
Figure 6:
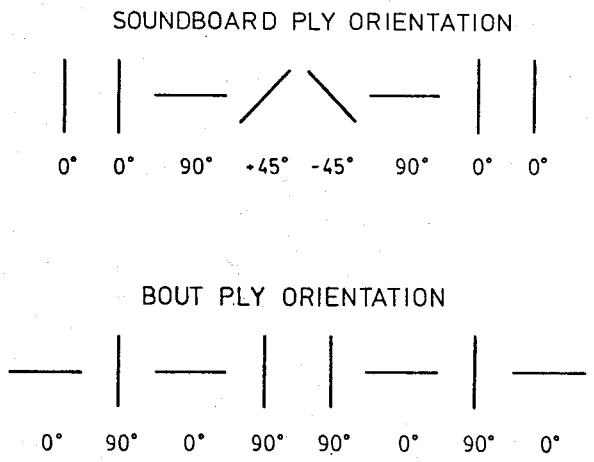

Two embodiments of the violin 10 were constructed, and the lay-up for the soundboard, back and bouts of these embodiments are illustrated in FIGS. 5 and 6, and will be discussed in greater detail below. These violins were modelled on a Joseph Guarnerius del Gesu violin, and construction techniques and materials were carefully selected and tailored to produce instruments with performance characteristics comparable to high quality violins.

The acoustic box 12 of the violin 10 has three major components: a sound board 24, a back 26, and sides constructed in six arcuate segments, namely, upper bouts 28, 30; inner bouts 32, 34; and lower bouts 36, 38. The soundboard 24 and back 26 are of substantially identical construction and shape, the soundboard 24 being distinguished by f-holes 39, provisions for receiving a bridge 18 etc. The soundboard 24 is of substantially conventional shape and dimension, except in cross-section. Whereas the soundboard of the conventional violin tapers from about 3/32 inches at the centre to about 1/16 inches at peripheral edges, the soundboard 24 is of substantially uniform thickness. Reinforcement of the centre of the soundboard 24 to accommodate string tension and downward forces transmitted at the bridge 18 were felt unnecessary because of the composite material and lay-up selected.

Sheets of unidirectional graphite fibres in an epoxy resin were used in the construction of the acoustic box 12. The selection of the resin matrix is not as critical as that of the fibres, and possible variations include modified epoxy, polyester and polysulphone. Suitable variations will be apparent to a person skilled in the art of fabricating composite materials. The composite sheets were obtained from Fiberite Corporation, Orange, Calif., U.S.A. These are designated as hy E Fiber (fibre produced by Union Carbide Corporation and sold under the designation Thornel or T300). The epoxy resin of the composite sheets cures at a temperature of 250 degrees F., under pressure ranging from a vacuum to 100 PSI.

The relative fibre and resin content of the sheets will significantly affect the vibrational characteristics of the soundboard 24. The content of the sheets actually used is 40 percent resin by volume, and 60 percent fibre by volume. Variations of the fibre content between 50–70 percent will produce a violin with pleasing tonal qualities, but 60 percent is preferred.

The sheets have a nominal thickness of 0.005 inches. The graphite fibre used is normally 6,000 filaments per tow, and is an intermediate to high modulus fibre. With the thickness and fibre content specified, and the lay-ups described below, providing 6 and 8 ply acoustic boxes, the weight of the finished violins were close to that of a conventional violin. Weight together with conventional structure were factors considered of some importance in obtaining ready acceptance of the composite violins by performers.

In a first embodiment of a violin 10, the sheets of composite material of the soundboard 24 were oriented as diagrammatically illustrated in FIG. 5. The relative orientation from left to right of the plies symbolically illustrated corresponds to the actual orientation of the plies from top to bottom. An innermost pair of plies were bonded directly to one another with their fibres oriented at acute angles of about 45 and minus 45 degrees relative to the longitudinal axis 40. A second pair of sheets were symmetrically placed about the first pair with their fibres oriented perpendicular to the longitudinal axis 40 of the violin 10 (indicated as a 90 degree orientation). An outermost pair of sheets was located about the previous sheets with fibres substantially aligned with the longitudinal axis 40.

The construction of the bouts of the acoustic box 12 is not as critical as that of the soundboard 24. In the first embodiment, the bouts are constructed in six plies, the fibres of two plies being oriented perpendicular to the longitudinal axis 40 (designated as 90 degree orientation), and the fibres of the remaining four plies being oriented perpendicular to those of the first two plies (designated a zero degree orientation). The lay-up of the bouts is also symmetric, being symmetric about a hypothetical curve of the general shape of the bouts. To this end, the plies of ninety degree orientation are bonded directly to one another, and the plies of zero degree orientation are placed symmetrically about the inner plies of ninety degree orientation. Many variations can be effected in the lay-up of the bouts, but the symmetric lay-up is preferred, even though the chance of warpage in the bouts is less likely by virtue of their shallow depth and pronounced curvature.

A second embodiment of the violin 10 involves an eight ply construction for the acoustic box 12, which construction is diagrammatically illustrated in FIG. 6. The various angles of the plies relative to the longitudinal axis 40, and their spacing relative to one another, are designated in an analagous manner to that used in respect of the first embodiment of the violin 10. The various positions of the plies from left to right as indicated in FIG. 6 designate their positions from top to bottom in the soundboard 24. The construction of the soundboard 24 differs from that previously described only by provision of a second set of longitudinally directed plies (designated as having a zero degree orientation) disposed about the outer plies. The construction of the bouts is once again not as critical as that of the soundboard 24, and the relative orientation of their plies is indicated in the same manner as before.

In both the six and eight ply embodiments of the acoustic box 12 the longitudinally directed plies (those whose fibres are aligned with the longitudinal axis 40) are located outermost in the lay-up. Such an arrangement is necessary to obtain sufficient stiffness in the longitudinal direction, as the moment of inertia of the soundboard 24 in the longitudinal direction would drop markedly if the longitudinal plies were innermost. The relative position of the inner pairs, namely, the pairs whose fibres are oriented at an acute angle or perpendicular to the longitudinal axis 40 may, however, be interchanged. Such interchangement will affect the vibrational character of the violin 10, but not as significantly as repositioning of the longitudinally directed plies, and will still produce a satisfactory instrument.

It will be appreciated that in the preferred embodiments of the violin 10 the back 26, soundboard 24 are of identical construction and they are in fact moulded with the same mould.

The construction of the soundboard 24, back 26, and the bouts of the violin 10 will now be discussed in general terms. Various detail respecting moulding and curing of the composite materials will be readily apparent to a person skilled in the art of composite material fabrication.

Female and male tools are prepared for the moulding of the soundboard 24 and sides of the violin 10. The female tool is a glass-epoxy mould formed in a conventional way from a wood master having an outer surface of the general shape of the soundboard 24. The female tool may alternatively be formed of cast or machined metal, or any other material, suitably shaped. In use, sheets of a composite material are simply overlapped and appropriately oriented in the female tool by hand.

A single male tool is used to construct the six bouts. The tool is formed from wood, phenolic, metal or any other suitable material, shaped to have flat, parallel top and back surfaces and a side surface about one and a half inches thick extending perpendicularly between the top and back surfaces. (The outline of the top and back is essentially that of a plan view of the soundboard 24). Strips or sheets of the composite material are simply wrapped about the side surface to define the six bouts. To impart a smooth finish to the bouts, an aluminum intensifier strip 0.012 inches in thickness is located over the sheets prior to curing. Alternatively a female mould may be used to impart a smooth surface finish on the exposed surfaces of the bouts. The intensifier strip is constructed in four separable parts which simply follow the contour of the side edge: two parts which cover the inner bouts, and two additional parts which cover the upper and lower bouts respectively.

To cure the soundboard 24 the moulding surface of the female tool is first treated with a release agent. Plies of the composite material are then overlaid with correct fibre orientation in the tool. A release film is placed over the plies and edges of the female tool (the release film being perforated to permit the escape of the volatiles during the curing process). A porous breather sheet is located over the release film so that vacuum can be applied with some measure of uniformity over the entire surface of the release films and underlying plies. The mould is then located in a PVA or nylon bag having a conventional connector that permits vacuum to be applied to the bag.

Curing is effected under a vacuum of 14 $lb/in^2$. (High pressure would significantly increase the modulus of elasticity of the plies, whose material properties have been carefully selected, and is consequently avoided). The temperature of the bag is raised from the ambient temperature of its surroundings to 250 degrees F. over the course of about one half hour. Curing is then continued at this temperature for one hour, after which the composite materials are allowed to cool undervacuum. The soundboard (or back) is formed is then removed and trimmed to size.

The bouts are cured in an analagous manner. However, no release film is used because of the presence of the aluminum intensifier. Instead, the intensifier has a release on its inner surfaces, or is treated with a releasing agent.

Figure 3:
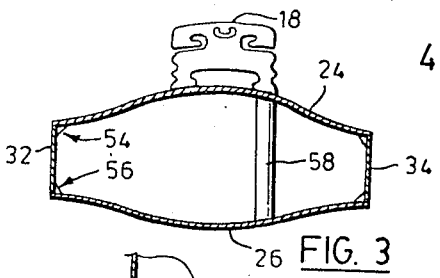
FIG. 3 is a sectional view along the lines 3—3 of FIG. 1.
Figure 4:
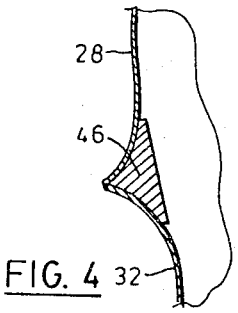
FIG. 4 is an enlarged view of the detail in circle 4 of FIG. 2.
Figure 2:
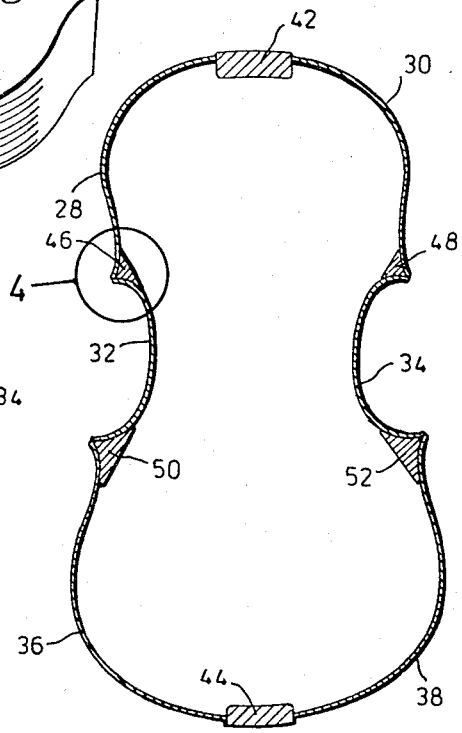
FIG. 2 is a sectional view along the lines 2—2 of FIG. 1.

Assembly of the violin 10 will be described with specific reference to FIGS. 2–4. The soundboard 24, back 26 and bouts are first trimmed to size. F-holes 39 are provided in the soundboard 24 with a tungsten carbide drill bit, and filed.

The various components of the violin 10 are bonded to one another with a flexibilized epoxy glue. A variety of adhesives can be used, including types which can be heated for example with a hot knife to permit removal of the soundboard for violin repair. Upper and lower wood blocks 42, 44 are bonded to the back 26, as are corner blocks 46, 48, 50, 52. The side bouts are then bonded to the wood blocks. Specific reference is made to FIG. 4, which is an enlarged view of detail about the corner block 46, illustrating a departure from conventional violin assembly.

In conventional violins only a limited bending of the side bouts is possible. Consequently, at corner blocks end portions of the bout are embedded in the blocks, and the blocks must be worked carefully to provide recesses of appropriate dimension to receive the bout end portions. As apparent in FIG. 4 the bouts 28, 32 are supported from behind by the corner block 46, and meet at a relatively sharp angle. The required curvature of the bouts 28, 32 at the corner block 46 can be readily achieved with the composite materials, thereby simplifying construction.

The neck 14 with its fingerboard is bonded to the upper block 42, and the soundboard 24 then bonded to the acoustic box 12. Epoxy fillets are apparent at 54, and 56, for example, in the cross-sectional views of FIG. 3, where wood lining strips might conventionally be used in bonding.

A conventional soundpost 58, a one-quarter inch diameter dowel of even grained pine, is inserted through the f-hole 39 in the soundboard 24, and wedged between the soundboard 24 and the back 26. It should be noted that the bass bar generally located beneath the G-string of a conventional violin has not been provided. The soundboard 24 proved sufficiently rigid in both the six and eight ply embodiments, and connection between the fastening of the bridge and the soundboard 24 could be effected well enough that the bass bar could be eliminated. If desired a bass bar can be added, and a composite bass bar integral with or secured to the soundboard 24 is a definite possibility.

Both the six and eight ply embodiments of the violin 10 were tested by a skilled violinist. The black finish of the acoustic box proved aesthetically acceptable, and performance of the instrument was quite satisfactory. The major difference between the six and eight ply violins appeared to be in the carrying power or volume. The six ply violin was considered suited to a small performance room, whereas the eight ply violin was considered better adapted to performance in larger halls or auditoriums.

In the soundboard of the eight-ply violin described above, twin plies with longitudinally-directed fibres were provided at both faces (top and bottom) of the soundboard 24. It will be appreciated that a single sheet of double thickness of the same composite material can be substituted for each of the twin sheets. Twin sheets were used to avoid the acquisition of different stock materials. In a similar manner, centermost sheets if provided, for example, with fibres perpendicular to the longitudinal axis can be replaced by a single sheet. Alternatively, multiple sheets can be substituted for single sheets where mechanically equivalent.

The composite sheet materials described above have a modulus of elasticity in about the $15\times10^6$ and $20\times10^6$ lb/in$^2$ range. Composite sheets of a lower inherent stiffness can be substituted by using higher pressures during curing, to thereby increase the ultimate stiffness of the members formed.

It will be appreciated that the construction techniques described above are applicable generally to violin-type instruments, including cellos, basses, contrabasses, and violas. Local strengthening of soundboards in the area of the bridge may be required with larger instruments, and thicker plies or a greater number of plies may also be required to obtain greater strength.

The individual composite components can themselves be used for repairs in conventional violins. In particular a replacement soundboard of composite materials, embodying the invention, could be substituted for an existing, damaged wood soundboard. It would be preferable in such circumstances to match the vibrational properties of the original soundboard as closely as possible.

I claim:

1. A violin-type musical instrument having an acoustic box generally of conventional violin acoustic box shape with a soundboard, a back, and sides, in which the soundboard comprises:

a first pair of sheets of unidirectional graphite fibres in a resin matrix, the fibres of the first pair of sheets substantially aligned with a longitudinal axis of the soundboard;

a second pair of sheets of unidirectional graphite fibres in a resin matrix, the fibres of one of the second pair of sheets oriented at an acute angle of predetermined magnitude relative to the longitudinal axis, the fibres of the other of the second pair of sheets oriented at an angle of substantially minus the predetermined magnitude;

the sheets bonded to one another in overlaid relationship with the sheets of each pair symmetrically placed about a hypothetical three dimensional curve of the general shape of the soundboard.

2. A musical instrument as claimed in claim 1 in which the first pair of sheets are located about the second pair of sheets, whereby, each of the first pair of sheets is further spaced from the hypothetical three-dimensional than either of the second pair of sheets.

3. A musical instrument as claimed in claim 2 comprising a third pair of sheets of unidirectional fibres in a resin matrix, the fibres of the third pair oriented substantially perpendicular to the longitudinal axis, the third pair of sheets bonded in overlaid relationship with the first and second pairs of sheets, with the sheets of the third pair symmetrically placed about the three dimensional curve, and located between the first pair of sheets.

4. A musical instrument as claimed in claim 3 in which the second pair of sheets are bonded directly to one another, and the third pair of sheets are located about the second pair.

5. A musical instrument as claimed in claim 2, 3 or 4 in which the predetermined magnitude is between about 30 and 60 degrees.

6. A violin having an acoustic box of conventional shape with a soundboard, a back and sides, in which the soundboard is constructed of six sheets of unidirectional graphite fibres in a resin matrix bonded in flat overlaid relationship, said sheets including a first pair whose fibres are substantially aligned with a longitudinal axis of the soundboard, said sheets including a second pair, the fibres of one of the second pair of sheets oriented at an acute angle of predetermined magnitude relative to the longitudinal axis, the fibres of the other of the second pair of sheets oriented at an acute angle of substantially minus the predetermined value relative to the longitudinal axis, said sheets including a third pair whose fibres are generally perpendicular to the longitudinal axis, one pair of said sheets bonded directly to one another and the sheets of each of the other pairs symmetrically placed about the one pair.

7. A violin as claimed in claim 6 in which the first pair of sheets are located about the second and third pairs of sheets.

8. A violin as claimed in claim 7 in which the predetermined magnitude is between 30 and 60 degrees.

9. A violin as claimed in claim 8 in which the second pair of sheets are the one pair bonded directly to one another.

10. A violin having an acoustic box of conventional size and shape with a soundboard, a back and sides, in which the soundboard is constructed of eight sheets of unidirectional graphite fibres in a resin matrix bonded in flat overlaid relationship, said sheets including first and second pairs whose fibres are substantially parallel to a longitudinal axis of the soundboard, said sheets including a third pair, the fibres of one of the third pair of sheets oriented at an acute angle of predetermined magnitude relative to the longitudinal axis, the fibres of the other of the third pair of sheets oriented at an angle of substantially minus the predetermined magnitude relative to the longitudinal axis, said sheets including a fourth pair whose fibres are generally perpendicular to the longitudinal axis, the sheets of one of said pairs of sheets bonded directly to one another and the sheets of each of the other pairs symmetrically placed about the one pair.

11. A violin as claimed in claim 10 in which the first and second pairs are located about the third and fourth pairs of sheets.

12. A violin as claimed in claim 11 in which the predetermined angle is between 30 and 60 degrees.

13. A violin as claimed in claim 12 in which the third pair of sheets are the one pair bonded directly to one another.

14. A violin having an acoustic box of conventional size and shape with a soundboard, back and sides, in which:

the soundboard is constructed of six sheets of unidirectional graphite fibres in an epoxy resin matrix bonded in overlaid relationship, said sheets having a generally uniform thickness of about 0.005 inches and a fibre content of about 60 percent fibre by volume said sheets including a first pair whose fibres are substantially aligned with a longitudinal axis of the soundboard, said sheets including a second pair disposed between the first pair, the fibres of one of the second pair of sheets oriented at an angle of about 45 degrees relative to the longitudinal axis, the fibres of the other of the second pair of sheets oriented at an angle of about minus 45 degrees relative to longitudinal axis, said sheets including a third pair of sheets whose fibres are oriented perpendicular to the longitudinal axis, one of the second and third pairs of sheets located between the other of the second and third pairs of sheets;

the back is constructed of a second set of six sheets of unidirectional graphite fibres in an epoxy resin matrix bonded in overlapping relationship, said second set of sheets having a generally uniform thickness of about 0.005 inches and a fibre content of about 60 percent fibre by volume, said second set of sheets including a first pair whose fibres are substantially aligned with a longitudinal axis of the back, said second set of sheets including a second pair disposed between the first pair, the fibres of one of the second pair of the second set of sheets oriented at an angle of about 45 degrees relative to the longitudinal axis of the back, the fibres of the other of the second pair of the second set of sheets oriented at an angle of about minus 45 degrees relative to longitudinal axis of the back, said second set of sheets including a third pair of sheets whose fibres are oriented perpendicular to the longitudinal axis of the back, one of the second and third pairs of the second set of sheets located between the other of the second and third pair of the second set of sheets; and, the sides are constructed of a plurality of arcuate panels adhesively secured to the soundboard and back, each panel constructed of three pairs of sheets of unidirectional graphite fibres in an epoxy resin matrix bonded in overlaid relationship, one pair of sheets of each panel having fibres oriented generally perpendicular to the fibres of the other two pairs of sheets of each panel, one pair of sheets of each panel bonded directly to one another and the sheets of each of the other pairs of sheets of each panel symmetrically placed about the one pair directly bonded to one another.

15. A violin having an acoustic box of conventional size and shape with a soundboard, back and sides, in which:

the soundboard is constructed of eight sheets of unidirectional graphite fibres in an epoxy resin matrix bonded in overlapping relationship, said sheets having a generally uniform thickness of about 0.005 inches and a fibre content of about 60 percent fibre by volume, said sheets including first and second pairs whose fibres are substantially aligned with a longitudinal axis of the soundboard, said sheets including third and fourth pairs disposed between the first and second pairs, the fibres of one of the third pair of sheets oriented at an angle of about 45 degrees relative to the longitudinal axis, the fibres of the other of the third pair of sheets oriented at an angle of about minus 45 degrees relative to longitudinal axis, the fibres of the fourth pair of sheets oriented perpendicular to the longitudinal axis, one of the third and fourth pairs of sheets located between the other of the third and fourth pair of sheets;

the back is constructed of a second set of eight sheets of unidirectional graphite fibres in an epoxy resin matrix bonded in overlapping relationship, said second set of sheets having a generally uniform thickness of about 0.005 inches and a fibre content of about 60 percent fibre by volume, said second set of sheets including first and second pairs whose fibres are substantially aligned with longitudinal axis of the back, said second set of sheets including third and fourth pairs disposed between the first pair, the fibres of one of the third pair of the second set of sheets oriented at an angle of about 45 degrees relative to the longitudinal axis of the back, the fibres of the other of the third pair of the second set of sheets oriented at an angle of about minus 45 degrees relative to longitudinal axis of the back, the fibres of the fourth pair of sheets oriented perpendicular to the longitudinal axis of the back, one of the third and fourth pairs of the second set of sheets located between the other of the third and fourth pairs of the second set of sheets; and, the sides are constructed of a plurality of arcuate panels adhesively secured to the soundboard and back, each panel constructed of four pairs of sheets of unidirectional graphite fibres in an epoxy resin matrix bonded in overlapping relationship, two pairs of sheets of each panel having fibres oriented generally perpendicular to the fibres of the other two pairs of sheets of each panel, one pair of sheets of each panel bonded directly to one another and the sheets of each of the other pairs of sheets of each panel symmetrically placed about the one pair directly bonded to one another.

* * * * *